US010736397B2

(12) United States Patent
Mehaddene et al.

(10) Patent No.: US 10,736,397 B2
(45) Date of Patent: Aug. 11, 2020

(54) EPILATOR

(71) Applicant: Braun GmbH, Kronberg (DE)

(72) Inventors: Tarik Mehaddene, Karben (DE); Frieder Grieshaber, Neu-Anspach (DE); Bernhard Kraus, Braunfels (DE)

(73) Assignee: Braun GMBH, Kronberg (DE)

( * ) Notice: Subject to any disclaimer, the term of this patent is extended or adjusted under 35 U.S.C. 154(b) by 212 days.

(21) Appl. No.: 16/007,460

(22) Filed: Jun. 13, 2018

(65) Prior Publication Data

US 2018/0368549 A1 Dec. 27, 2018

(30) Foreign Application Priority Data

Jun. 23, 2017 (EP) ..... 17177690

(51) Int. Cl.

*A45D 26/00* (2006.01)
*B26B 21/40* (2006.01)
*B26B 21/44* (2006.01)

(52) U.S. Cl.

CPC ..... *A45D 26/0038* (2013.01); *A45D 26/0023* (2013.01); *A45D 26/0028* (2013.01); *B26B 21/4012* (2013.01); *B26B 21/4037* (2013.01); *B26B 21/4062* (2013.01); *B26B 21/446* (2013.01); *A45D 2026/0095* (2013.01)

(58) Field of Classification Search

CPC ..... A22B 5/08; A45D 26/00; A45D 26/0033; A45D 26/0038; A45D 26/0028; A45D 26/0023; A45D 26/0052; A45D 26/0047; A45D 26/0095; A45D 26/008; B26B 21/446; B26B 21/4062; B26B 21/4037; B26B 21/4012

USPC ..... 30/34.2; 606/133; 132/289

See application file for complete search history.

(56) References Cited

U.S. PATENT DOCUMENTS 8,870,896 B2 * 10/2014 Grieshaber ..... A45D 26/0061 606/133
9,247,798 B2 2/2016 Sanchez-Martinez et al.
2010/0234858 A1 * 9/2010 Sanchez-Martinez ..... B26B 21/00 606/133
2010/0274261 A1 * 10/2010 Grieshaber ..... B26B 19/3813 606/133

FOREIGN PATENT DOCUMENTS

JP H11187924 7/1999
WO WO2013153320 10/2013

OTHER PUBLICATIONS

European search report dated Aug. 22, 2017.

* cited by examiner

*Primary Examiner* — Elizabeth Houston
*Assistant Examiner* — Socrates L Boutsikaris
(74) *Attorney, Agent, or Firm* — Kevin C.q Johnson; Gerd Zetterer

(57) ABSTRACT

The present invention is concerned with an epilator for removing body hair. The epilator comprises a body having a head section, a plucking cylinder which is rotatable about a first rotation axis in the head section for plucking hairs and at least one shaving blade for shaving off hairs, which is mounted in the head section movable with respect to the plucking cylinder. The at least one shaving blade is movable between a retracted position in which the at least one shaving blade does not protrude from the head section and an extended position in which the at least one shaving blade protrudes from the head section.

5 Claims, 1 Drawing Sheet

EPILATOR

FIELD OF THE INVENTION

The present invention is concerned with an epilator for removing body hair. The epilator comprises a body or housing having a head section, a plucking cylinder which is rotatable about a first rotation axis for plucking hair, especially a plucking cylinder having preferably pincer-like clamping elements for plucking hair when in contact with a user's skin, and at least one shaving blade for shaving off hairs when in contact with a user's skin. The at least one shaving blade is mounted in the head section movable with respect to the plucking cylinder.

The head section of the epilator body or housing may be an integral part of the housing or body or, alternatively, may be a detachable component part. The plucking cylinder may be mounted at the epilator housing or body and may extend through an opening in the head section. Typically, the rotation axis is at least substantially parallel to the user's skin during use of the epilator, i.e. during hair removal.

BACKGROUND OF THE INVENTION

Wet shaving and epilation are one of the most used methods for hair removal. Whereas hair removal by root (epilating) ensures a hair-free skin for weeks, wet shaving offers a smooth skin in few strokes and delivers a great skin feeling. The combination of both constitutes a huge potential in hair removal. A hair removal device featuring both an epilation barrel and a shaver blade addresses the most important desired consumer experiences, especially in the female hair removal market.

The presence of a blade on such an appliance requires the use of shave preps in form of water, gel or foam. The hair removal takes then usually place in a wet environment. Because of the relatively bulky shape of the appliance, the slippery handle (combination of water and shave preps), and the reduced sight onto the blade (mounted on the back side), the use of an Epilator featuring a blade can constitute a risk of cuts to the user. This risk can increase the fear of usage. Moreover, the result of the hair removal achieved by the use of such an appliance depends strongly on the handling of the device. If the appliance is tilted too much to the front, the blade lifts up from the skin and hairs are only removed by the root. The smooth skin benefit disappears and the efficiency strongly decreases. Finally, the rotary movement of the epilation barrel can lead to splash around fluid (water and shave preps) during usage. This is inconvenient for the user, especially when the appliance is lifted up from the skin.

An epilator with a plucking cylinder and a shaving blade is known e.g. from EP 2 220 958 B1. This apparatus comprises a frame carrying the shaving blade, wherein the frame is pivotable relative to the housing of the epilator and the plucking cylinder attached thereto. Due to the ability of adapting the orientation of the blades to the skin contour, this avoids some of the above mentioned drawbacks of known combinations of an epilator and a shaver.

It is an object of the present disclosure to provide an improved epilator avoiding drawbacks of known devices and increasing consumer safety.

SUMMARY OF THE INVENTION

In accordance with one aspect of the present disclosure, in an epilator as defined above the at least one shaving blade may be transferred between a retracted position and an extended position. In the retracted position, the at least one shaving blade does not protrude from the head section, whereas in the extended position, the at least one shaving blade does protrude from the head section. When the blade is hidden, i.e. in its retracted position, this prevents injuries which may result from unintentional contact of a user's skin with the blade. Thus, the transfer of the at least one blade between the retracted position and the extended position may protect the user from cuts caused by the blades, e.g. when they are unintentionally hit or when the appliance slips out of hand (wet usage). In addition, this protects blades when the appliance is not used, respectively switched off. Further, self-cleaning of the blades after each stroke may be implemented. Hiding the at least one blade may further reduce the harsh appearance of the appliance. When the epilator is applied onto the skin, it may be pressed against the skin, this may cause the blade to be transferred into the extended position suitable for shaving use.

For example, a transfer of the at least one shaving blade between the retracted position and an extended position may involve a movement of the at least one shaving blade with respect to the head section and/or the plucking cylinder. In addition or as an alternative, the transfer of the at least one shaving blade between the retracted position and an extended position may involve shielding of the at least one shaving blade.

Further details and features of the invention may be obtained from the following description of embodiments in conjunction with the drawings.

DETAILED DESCRIPTION OF THE INVENTION

Figure 1A:
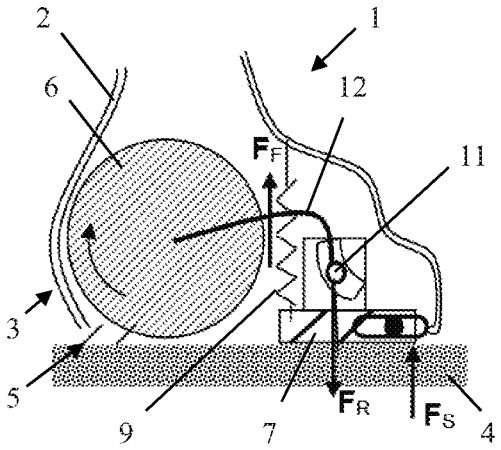
FIG. 1*a* shows in a schematic sectional view an epilator according to a first embodiment of the invention in an extended state.

According to an embodiment of the present disclosure, the at least one shaving blade is movable with respect to the head section for transferring the at least one shaving blade from the retracted position to the extended position and vice versa. For example, the at least one shaving blade may be pivotably mounted in the head section such that the at least one shaving blade may swivel between the retracted position and the extended position.

The epilator, especially the head section, may comprise at least one elastically deformable element, e.g. a spring, biasing the at least one shaving blade to its retracted position. This includes an arrangement where the elastically deformable element moves the at least one shaving blade into its retracted position and further includes an arrangement where a separate component, e.g. a cap or the like, is moved by the elastically deformable element into the retracted position of the at least one shaving blade, i.e. a position in which the separate component shields the at least one shaving blade.

An epilator according to the present disclosure may further comprise an electric motor for driving the plucking cylinder and a contact switch for actuating the electric motor. In addition, an energy source, for example a rechargeable battery or a power connector, may be provided for driving the electric motor. The contact switch may be activated using a pressure, proximity, heat or a contact sensor. The sensor can be used to control the appliance. In other words, the epilator turns on when the user sets the epilator on the skin and the blade is pressed against the skin with a given force. The epilator remains switched on as long as the blade is in contact with the skin and the force is lower than a given force value. On the other hand, the epilator turns off when the user exerts a force higher than a given force value. This feature may alert the user when exerting a too strong pressure on the blade which may result from a wrong handling, e.g. if the epilator is tilted too much to the back, or the user is pressing too much on the whole appliance.

Thus, provision of a contact switch not only ensures a correct handling of the appliance for an optimal ratio of epilated and shaved hairs but also allows for a pressure control of the blade on the skin for a gentle hair removal and perfect adaptation. Further, the provision of the contact switch may reduce noise and/or pain during use of the epilator and thereby contribute in a pleasant hair removal experience. As an additional benefit the use of the contact switch may reduce the current consumption and may thereby increase the runtime of battery appliances especially for usage under water. Further, this prevents water from splashing around during usage, when the epilator is lifted up from the skin.

The epilator may comprise one single shaving blade. However, it may be preferable to provide several shaving blades in the epilator to increase the shaving result with one shaving stroke. The at least one shaving blade may be mounted in a cartridge which is movable between a retracted position in which the at least one shaving blade does not protrude from the head section and an extended position in which the at least one shaving blade protrudes from the head section. The pressing force applied by the user during use of the epilator may be used to control the movement of the cartridge. If the pressing force is low, the cartridge/blade remains at the surface. If the force is too high, the cartridge can be moved away from the skin for a better skin care. Alternatively, the blades can be actively positioned by a motor to fit to the different contours of the skin.

In the epilator according to the present disclosure, the at least one blade and/or the cartridge may be connected to a lever mechanism for pivoting the at least one blade and/or the cartridge about a pivoting axis provided at the head section. For example, the movement of the cartridge/blade can be inspired by the movement of the rubber plate of a self-inking stamp widely used in offices. However, a rotation of less than 180°, for example only 90°, may be fully sufficient for the cartridge or blade.

According to a further alternative, the movement of the cartridge/blade can be controlled by a contact-switch. When the epilator is set onto the skin, the contact switch is activated and sets the appliance motor or a separate motor into motion. The motor drives the cartridge/blade out of the housing to the surface. The cartridge/blade remains on the surface as long as the epilator is in contact with the skin. If the epilator is lifted up from the skin, the contact switch turns in the off-state and stops the motor. A pull-spring can be used to pull the cartridge/blade back into the housing.

The contact switch can be an optical, mechanical, electrical or an electromechanical component. The contact switch can be used to control, in addition to the movement of the cartridge/blade, the rotation of the epilation barrel (plucking cylinder). For instance, a spring-loaded contact switch can be used to break the electrical circuit and interrupt the current delivery to the motor when the spring is released, that is when the epilator is not in contact with skin. Setting the epilator onto the skin causes the compression of the spring which closes the electrical contacts allowing electricity to flow from the power supply to the motor. Lifting up the epilator from the skin releases again the spring which opens the electrical contact and stops the rotation of the motor. This feature prevents water from splashing around when the epilator is lifted up from the skin, reduces the noise experienced during usage, and decreases current consumption.

The contact switch can be activated when the optimal pressure of the blade on the skin is reached. Any wrong handling by tilting the epilator too much forwards is systematically followed by switching-off the appliance, giving a direct feedback to the user for a correct handling. This feature is especially helpful for new users because they tend to tilt the epilator too much (in most cases forwards), thus lifting up both the plucking cylinder and the blade from the skin, reducing the plucking efficiency and limiting the action of the blade, respectively. Thus, this feature may serve as a learning tool for a correct handling to avoid inefficient moves. In addition, it may ensure an optimal ratio of hair removed by the root and cut at the surface, thereby delivering a great skin feeling.

In an example of the present disclosure, the lever mechanism may comprise a yoke spring coupled to the plucking cylinder such that upon rotation of the plucking cylinder the yoke spring exerts a force onto the cartridge for pivoting the cartridge about the pivoting axis into the extended position. In more detail, the cartridge may comprise a curved guide track and that the yoke spring may comprise a sliding block guided in the guide track. Thus, the movement of the yoke spring costs by actuation of the plucking cylinder may result in pivoting the cartridge into the extended position. In this arrangement, the movement of the cartridge/blade can be coupled to the epilator status. When the epilator is turned off, the cartridge/blade is hidden, embedded in a housing mounted in the attachment or in the body of the epilator. When the appliance turns on, the cartridge/blade is moved out of the housing and appears at the surface. The motor of the epilator can, for instance, be used to drive the movement of the cartridge/blade. When the epilator is turned on, the moment of force of the motor can be transmitted to the cartridge/blade and drive it out of the housing. A spring can be used to pull the cartridge/blade back into the housing as soon as the epilator is turned off. As an alternative, the movement of the cartridge/blade or a cap shielding the blade can be driven by a separate motor.

In another embodiment of the present disclosure, the lever mechanism comprises a roller suitable for contacting a user's skin. The roller may be rotatable about a second rotation axis in the head section and may be movable relative to the head section in a direction perpendicular to the second rotation axis, e.g. when in contact with a user's skin. Further, the roller may be coupled to the cartridge or blade such that a force exerted on the roller in the direction perpendicular to the second rotation axis is transmitted in a force pivoting the cartridge or blade about the pivoting axis into the extended position. In other words, the at least one blade is retracted or shielded by a cap as long as the roller is in an idle state not contacting the user's skin. In more detail, the lever mechanism may comprise a lever arm mounted in the head section pivotably about the pivoting axis with the cartridge being arranged on one side of the lever arm, wherein the roller may be arranged at an opposite side of the lever arm and the pivoting axis may be located between the cartridge and the roller.

The roller may further be used to activate, i.e. turn on or off, the epilator. For example, the contact switch may be coupled to the lever mechanism such that the contact switch is actuated depending on the position of the roller with respect to the head section.

In the epilator of the present disclosure the lever mechanism may further comprise a release mechanism comprising a further switch for switching between a release mode in which pivoting of the cartridge or blade into the extended position is permitted and a blocking mode in which pivoting of the cartridge or blade into the extended position is prevented irrespective of the force exerted on the roller in the direction perpendicular to the second rotation axis.

The epilator may further comprise an electrically operated drive unit for moving the cartridge and/or the at least one blade between the retracted position and the extended position. Instead of a movable cartridge/blade, a cap driven by a separate motor, or coupled to the appliance motor, can slide over and cover the cartridge/blade. That is, the cap covers the cartridge/blade as long as the epilator is off. The cap is pulled away, uncovering the cartridge/blade when the epilator is turned on. Still further, an attachment may be used for the protection. The attachment may be spring-loaded and mounted in a way that a given offset in height between the top of the attachment and the blade/plucking cylinder is ensured when the epilator is not in contact with the user's skin. Thus, the blade is hidden, preventing from injuries which may result from unintentional contact with the blade. However, when the epilator is applied onto the skin, the attachment is pressed against the skin until the cartridge/blade and plucking cylinder come in contact with the skin. The attachment may cover both plucking cylinder and cartridge/blade or only the cartridge/blade.

The movement of the cartridge/blade may be used for cleaning of the at least one blade. In this respect at least one lamella may be arranged in the head section such that the at least one shaving blade contacts the lamella during movement from the extended position to the retracted position. In other words, the movement of the cartridge/blade may be combined with the movement of the lamella, e.g. rubber lips, which slide between the blades and push away the rest of shave preps and hair-debris. The lips move forth when the cartridge/blade is in contact with the skin and back as soon as the cartridge/blade is lifted up from the skin. The rubber lips clean the blades and remove the rests accumulated in the front of each blade after each stroke. The cleaning may be complemented by an air blowing or a sucking action.

The epilator may further comprise at least one reservoir containing a skin care product. For example, the reservoir has a dispensing outlet located interposed between the plucking cylinder and the at least one shaving blade in a direction perpendicular to the first rotation axis. The reservoir may contain a post-epilation treatment in form of a lotion or cream or may be used as an applicator of the cosmetic on the user's skin. The contact-switch may be used to control a pump for the cosmetic delivery. The pump turns on when the cartridge is in contact with skin and pumps the cosmetic from a tank to the skin through the cartridge. The pump turns off when the appliance is lifted up from the skin. Alternatively, the cosmetic application can follow up in a similar way to the ink-transfer while using a self-inking office stamp.

Irrespective of the above features, the epilator may further comprise a first elastically deformable element biasing the plucking cylinder which is movable between an extended position and a retracted position into the extended position, for example with an adjustable biasing force. The epilator may further comprise at least one roller arrangement having at least one further elastically deformable element and at least two rollers mounted on the same side of the body as the plucking cylinder with the plucking cylinder interposed between the rollers. The rollers are, e.g. individually or jointly, movable with respect to the body between an extended position and a retracted position, with the at least one further elastically deformable element biasing the rollers into the extended position. For example, the roller arrangement comprises two rollers, each having a separate elastically deformable element for individually moving each roller relative to the between the extended and retracted positions. Alternatively, the roller arrangement may comprise a frame supporting two or more rollers and having one or more elastically deformable elements for biasing the rollers, e.g. jointly, into the extended position.

The rollers, the plucking cylinder and the elastically deformable elements are arranged and adapted such that when pressing the rollers and the plucking cylinder to a flat surface, e.g. a portion of a user's skin, the force exerted by the rollers exceeds the force exerted by the plucking cylinder. That is, the sum of the biasing forces exerted by the at least one elastically deformable element of the rollers exceeds the sum of the biasing forces exerted by the at least one elastically deformable element of the plucking cylinder. Preferably, the biasing force exerted on the rollers is adjustable. In other words, the force generated in response to pressing the epilator to a surface, like a skin portion, is mainly reacted by the rollers. This has the effect that the epilator, despite the plucking cylinder being in close contact to the surface, does not suffer from detrimental effects which are based on increased friction between the skin and the plucking cylinder.

Reducing the force exerted to the plucking cylinder during use of the epilator may be effected in that the resulting spring constant of the at least one elastically deformable element biasing the plucking cylinder into the extended position is smaller than the resulting spring constant of the at least one further elastically deformable element biasing the rollers into the extended position. In addition or as an alternative, the maximum movement of the rollers with respect to the body may be limited to be smaller than the maximum movement of the plucking cylinder with respect to the body.

In an unstressed condition of the elastically deformable elements a surface of the rollers facing away from the body may define a plane wherein the plucking cylinder is offset relative to this plane towards the body. In other words, the plucking cylinder and the rollers are mounted in or on the body such that in the extended idle state the rollers protrude from the body further away by a given offset than the plucking cylinder in a direction perpendicular to the rotation axis.

Preferably, the skin treatment apparatus further comprises at least one detector for detecting approximation of the plucking cylinder and/or rollers to the skin of a user or detecting contact of the plucking cylinder and/or rollers with the skin of a user. The detector is coupled to the control unit for transmitting a signal to the control unit. Further, the control unit is designed and arranged such that it controls activation of the drive unit and/or the plucking cylinder depending on the signal received from the detector. In other words, actuation of the plucking cylinder and/or rollers depends on whether or not the skin treatment apparatus is in contact with the skin of a user or at least close to contacting the skin of a user. For example, the springs acting on the plucking cylinder and/or the springs acting on the rollers can be used as contact-switches to close and open the electrical circuit and command the current delivery to the motor. The epilator is on when the springs are compressed (epilator on the skin) and turns off when they are released (epilator lifted up from the skin). Generally, the detector comprises at least one of a mechanical detector, a pressure sensor, a proximity sensor, a heat sensor and a contact sensor. In addition or as an alternative to the control unit switching the drive unit on and off, the control unit may tune the speed of the drive unit depending on the signal received from the detector(s).

Figure 1B:
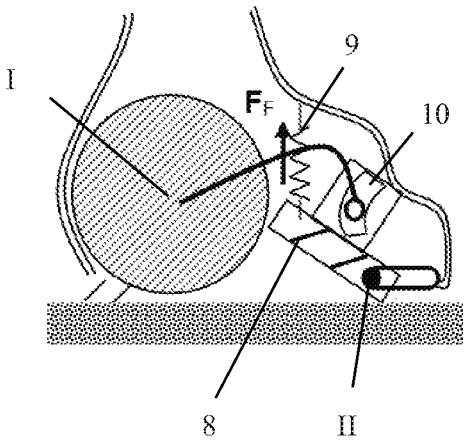
FIG. 1*b* shows the epilator of FIG. 1*a* in a retracted state.

In the embodiment of FIGS. 1*a* and 1*b* an epilator 1 is partially shown comprising a body 2 or outer housing and a head section 3 which is directed to the user's skin 4 during operation of the epilator 1 for removing hairs 5. Although not depicted in detail, the head section 3 may be detachable from the body 2. A drive unit (not shown) is provided within the body 2 comprising an, e.g. rechargeable, battery and an electric motor.

The electric motor is coupled, e.g. by a gearing, to a plucking cylinder 6, i.e. an epilator drum with e.g. pincer-like clamping elements for plucking and removing hairs 5 from a user's skin 4 when the plucking cylinder 6 rotates. The plucking cylinder 6 is mounted in the body 2 or in the head section 3 rotatable about a first rotation axis I.

The epilator 1 further comprises a cartridge 7 with two shaving blades 8. Although two shaving blades 8 are depicted in the embodiment of FIGS. 1*a* and 1*b*, one single shaving blade 8 or more than two shaving blades 8 may be provided in the cartridge 7. The cartridge 7 is mounted in the body 2 or in the head section 3 pivotable about a pivoting axis II. In other words, the cartridge 7 may swivel from an extended position in which the at least one shaving blade 8 protrudes from the body 2 and the head section 3 towards the user's skin 4 (FIG. 1*a*) to a retracted position in which the at least one shaving blade 8 does not protrude from the body 2 and the head section 3 (FIG. 1*b*). In the exemplary embodiment depicted in FIGS. 1*a* and 1*b*, the pivoting axis II is guided in a long hole of the body 2.

A spring 9 is connected with one end to the cartridge 7 and with the opposite end to the body 2 or of the head section 3 of the epilator 1. The spring 9 is chosen and arranged such that it is tensioned when the cartridge 7 is in its extended position, such that the spring 9 biases the cartridge 7 towards its retracted position with a force $F_F$.

The cartridge 7 further comprises a guide track 10 which is curved in the embodiment depicted in FIGS. 1*a* and 1*b*. A sliding block 11 is guided in the guide track 10. The sliding block 11 is arranged on or part of a yoke spring 12 which interacts with the plucking cylinder 6 such that rotation of the plucking cylinder 6 causes of the yoke spring 12 to exert a force $F_R$ via the sliding block 11 to the guide track 10, thereby pivoting the cartridge 7 with the shaving blades 8 into the extended position against the bias of spring 9. The yoke spring 12 with the sliding block 11 and the guide track 10 form a lever mechanism for actuating the cartridge 7 and the shaving blades 8. In other words, upon actuation of the plucking cylinder 6 the cartridge 7 with the shaving blades 8 is automatically brought into the extended position suitable for cutting off hairs 5 from the user's skin 4. In this position, a reaction force $F_S$ acts on the cartridge when the cartridge contacts the skin. On the other hand, the cartridge 7 with the shaving blades 8 is automatically brought back into the retracted position due to the force of spring 9 when the force $F_R$ disappears by stopping rotation of the plucking cylinder 6. Thereby, the shaving blades 8 are brought into the retracted position in which a user is protected from cuts caused by the blades 8 and the blades 8 are protected and hidden.

In the epilator 1, the combination of hair removal by root by means of the plucking cylinder 6 ensures a hair-free skin 4 for several weeks, whereas the wet shaving by means of the shaving blades 8 provides for a smooth skin 4 in few strokes and causes a good skin feeling. In the embodiment of FIGS. 1*a* and 1*b* the plucking cylinder 6 and the cartridge 7 with the shaving blades 8 are arranged such that during operation of the epilator 1 in the direction of use hairs 5 are first removed by root by the plucking cylinder 6 and thereafter remaining hairs 5 are shaved off by the blades 8. In other words, during operation of the epilator 1 is moved from right to left as seen in FIGS. 1*a* and 1*b*.

A second embodiment of an epilator 1 is depicted in FIGS. 2*a* to 2*d*. In this embodiment the body 2 and portions of the head section 3 are not depicted to get a better understanding of the internal component parts of the epilator 1. A frame 13 is depicted which may be part of the body 2 or of the head section 3. In addition to the plucking cylinder 6 and the cartridge 7 with the shaving blades 8, the epilator 1 further comprises two stimulation elements in the form of rollers 14 provided on either side of the plucking cylinder 6. The plucking cylinder 6 and the rollers 14 are each supported in a rotatable manner about a respective axis, namely the first rotation axis I of the plucking cylinder 6 and second rotation axes III of the rollers 14, which extend perpendicular to the plane of the drawings, i.e. the axes are parallel to each other and in use, at least substantially, parallel to the user's skin 4.

The frame 13 is connected to a lever mechanism comprising comprises a lever arm 15 mounted in the head section 3 pivotably about the pivoting axis II. The cartridge 7 is arranged on one side of the lever arm 15 (left side in FIGS. 2*a* to 2*d*) and one of the rollers 14 is arranged at the opposite side of the lever arm 15 (right side in FIGS. 2*a* to 2*d*). The pivoting axis II is located between the cartridge 7 and the roller 14, for example substantially in the middle of the lever arm 15. The spring 9 is attached to the cartridge 7 and the frame 13 in a similar manner as in the first embodiment, i.e. with the spring 9 biasing the cartridge 7 with the shaving blades 8 into the retracted position. With this arrangement of the lever arm 15, the cartridge 7 and the roller 14, the cartridge 7 may pivot between the retracted position shown in FIG. 2*a* and the extended position shown in FIG. 2*b*, respectively. In more detail, a force F exerted on the roller 14 due to contact with the user's skin 4 results in swiveling of the cartridge 7 about the pivoting axis II against the bias of the spring 9 into the extended position. On the other hand, the spring 9 retracts the cartridge 7 into the retracted position as soon as the roller 14 is lifted from the user's skin 4.

The lever arm 15 is connected to the frame 13 by means of two hinged arms 16, 17 which form together with a switch 18 a release mechanism. By means of the switch 18, the hinged arms 16, 17 may be brought into a release mode (FIGS. 2*a* and 2*b*) permitting pivoting of the cartridge 7 into the extended position and a blocking mode (FIGS. 2*c* and 2*d*) in which pivoting of the cartridge 7 into the extended position is prevented irrespective of the force exerted on the roller 14 in the direction perpendicular to the second rotation axis III.

Figure 2C:
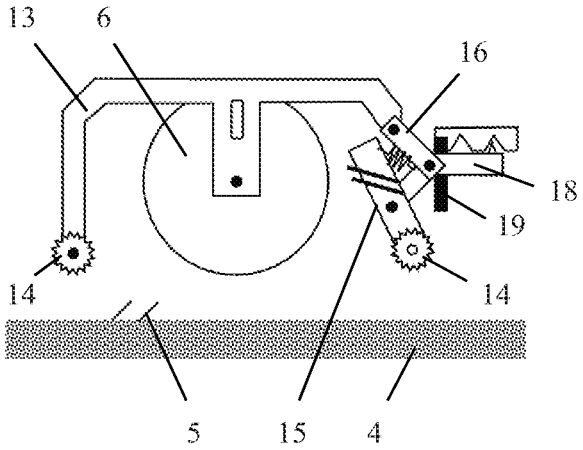
FIG. 2*c* shows the epilator of FIG. 2*a* in a blocked idle state.
Figure 2A:
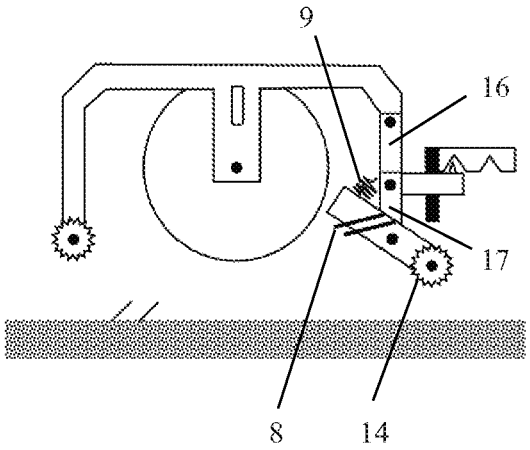
FIG. 2*a* shows in a schematic sectional view an epilator according to a second embodiment of the invention in a retracted state.
Figure 2D:
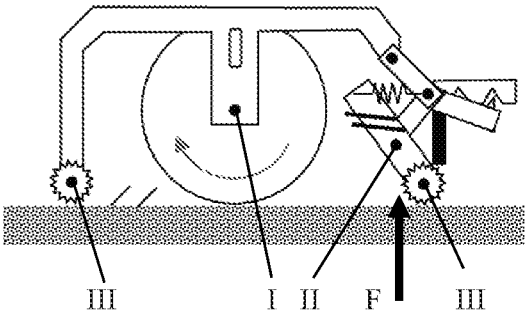
FIG. 2*d* shows the epilator of FIG. 2*a* in a blocked skin contact state.
Figure 2B:
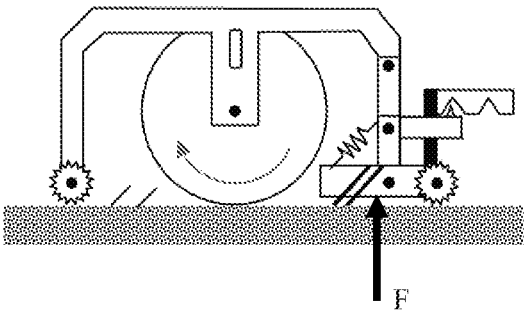
FIG. 2*b* shows the epilator of FIG. 2*a* in an extended state.

In the depicted embodiment, the hinged arms 16, 17 extend substantially one behind the other, i.e. forming a straight line, in the release mode, whereas the hinged arms 16, 17 are inclined relative to each other in the blocking mode, thereby retracting the roller 14 with respect to the frame 13. Comparing FIGS. 2*a* and 2*c* shows that the inclined orientation of the hinged arms 16, 17 in the blocking mode results in a retraction of the lever arm 15 with the roller 14 towards the frame 13 such that the lever arm 15 is only slightly deflected when contacting the user's skin 4. Consequently, a contact of the roller 14 with the user's skin 4 does not cause swiveling of the lever arm 15 to an extent sufficient for moving the cartridge 7 with the shaving blades 8 into the extended position. In the embodiment of FIGS. 2*a* to 2*d*, the switch 18 is depicted with a snap element releasably fixing the switch 18 either in the release mode or in the blocking mode.

The embodiment of FIGS. 2*a* to 2*d* shows the epilator 1 with an optional additional feature of a mechanical contact switch 19 for actuating the (not shown) motor driving the plucking cylinder 6. The contact switch 19 may for example be arranged at or near the hinge between the hinged arms 16, 17 such that the lever arm 15 may abut the contact switch 19 when pressed against the user's skin 4. In other words, the epilator 1 and its plucking cylinder 6 may be switched off in an idle state of the roller 14 not contacting the user's skin 4, whereas the motor driving the plucking cylinder 6 of the epilator 1 is automatically switched on as soon as the epilator 1 is placed on the user's skin 4 with a sufficient force F, thereby pivoting of the lever arm 15 against the bias of the spring 9.

Although not as depicted in the Figures, as an alternative to the mechanical contact switch 19 an optical, electrical or an electromechanical component may be used as a contact switch. Such a contact switch may be used to control not only the actuation of the plucking cylinder 6 but also movement of the cartridge 7 and the shaving blades 8 which may be provided with a separate drive unit for bringing the cartridge 7 in the retracted position and the extended position, respectively. Such a contact switch or the mechanical contact switch 19 may further be used for pressure control preventing that a user exerts either a too high or a too low force with the epilator 1 on the skin 4, for example due to an improper alignment or orientation of the epilator 1 during use.

As a further alternative to the embodiments depicted in the Figures, a cap or the like may be provided shielding of the cartridge 7 and/or the shaving blades 8 instead of actively moving the cartridge 7 into the retracted position. In other words, the cartridge 7 with the shaving blades 8 may be kept stationary, while the cap is moved with respect to the cartridge 7 for switching between the retracted position and the extended position.

In addition, although not depicted in the Figures, a lamella may be provided for cleaning the shaving blades 8 when pivoting from the extended position to the retracted position and/or vice versa. Further, a reservoir (not shown) containing e.g. a skin care product may be provided in or at the epilator 1. For example, a dispensing outlet of the reservoir may be arranged between the plucking cylinder 6 and the cartridge 7 with the shaving blades 8.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An epilator for removing body hair, comprising:

a body having a head section, a plucking cylinder rotatable about a first rotation axis in the head section for plucking hairs, and at least one shaving blade for shaving off hairs, wherein the at least one shaving blade is mounted in a cartridge in the head section and is movable with respect to the plucking cylinder, wherein the at least one shaving blade is transferable between a retracted position in which the at least one shaving blade does not protrude from the head section and an extended position in which the at least one shaving blade protrudes from the head section, wherein the cartridge is connected to a lever mechanism for pivoting the cartridge about a pivoting axis provided at the head section, wherein the lever mechanism comprises a yoke spring coupled to the plucking cylinder such that upon rotation of the plucking cylinder the yoke spring exerts a force onto the cartridge for pivoting the cartridge about the pivoting axis into the extended position.

2. The epilator in accordance with claim 1, wherein the at least one shaving blade is pivotably mounted in the head section.

3. The epilator in accordance with claim 1, wherein the head section comprises at least one elastically deformable element biasing the at least one shaving blade to the retracted position.

4. The epilator in accordance with claim 1, further comprising an electric motor for driving the plucking cylinder and a contact switch for actuating the electric motor.

5. The epilator in accordance with claim 1, wherein the cartridge comprises a curved guide track and the yoke spring comprises a sliding block guided in the guide track.

* * * * *